US005420598A

United States Patent [19]

Uematsu et al.

[11] Patent Number: 5,420,598

[45] Date of Patent: May 30, 1995

[54] ANTENNA WITH OFFSET ARRAYS AND DUAL AXIS ROTATION

[75] Inventors: Masahiro Uematsu, Tokyo; Kazuo Kato, Yokohama, both of Japan

[73] Assignees: Nippon Steel Corporation, Tokyo; System Uniques Corporation, Kanagawa, both of Japan

[21] Appl. No.: 904,028

[22] Filed: Jun. 25, 1992

[30] Foreign Application Priority Data

Jun. 26, 1991 [JP] Japan ..... 3-182031

[51] Int. Cl.[6] ..... H01Q 3/08

[52] U.S. Cl. ..... 343/765; 343/766

[58] Field of Search ..... 343/757, 758, 763, 765, 343/766, 882; H01Q 3/00, 3/02, 3/08

[56] References Cited

U.S. PATENT DOCUMENTS 4,295,621 10/1981 Siryj ..... 343/882

FOREIGN PATENT DOCUMENTS 0338379 10/1989 European Pat. Off. .
0373604 6/1990 European Pat. Off. .
1228144 4/1960 France ..... 343/758
1-261005 10/1989 Japan .
2-159802 6/1990 Japan .
2-250502 10/1990 Japan .
3-247003 11/1991 Japan .

*Primary Examiner*—Michael C. Wimer
*Attorney, Agent, or Firm*—Pollock, Vande Sande & Priddy

[57] ABSTRACT

The present invention relates to an antenna apparatus for a moving object. It comprises a casing mountable on a moving object and a base plate rotatably supported for rotation about a first rotary shaft which is fixed to the casing. A first drive is provided for rotatably driving the base plate about the first rotary shaft. An antenna unit includes a first antenna plate having a predetermined first beam axis, a second antenna plate having a predetermined second beam axis and connecting member for connecting the first and second antenna plates, with the first and second beam axes being oriented parallel to each other and with the antenna plates being positioned at a predetermined fixed offset distance between them along a line which is parallel to the first and second beam axes. The antenna unit is rotatable about a second rotary shaft perpendicular to the first rotary shaft and second drive is provided for rotatably driving the antenna unit about the second rotary shaft perpendicular to said first rotary shaft.

30 Claims, 9 Drawing Sheets

ANTENNA WITH OFFSET ARRAYS AND DUAL AXIS ROTATION

BACKGROUND OF THE INVENTION

The present invention relates to an antenna apparatus for a moving body, such as an automotive vehicle, a ship and so forth. More specifically, this invention relates to an antenna apparatus for receiving on a moving body radio wave transmitted from a broadcasting satellite.

One example of the conventional antenna for a moving body is disclosed in Japanese Unexamined Patent Publication JP-A-2-159802, in which a plane antenna is divided into a plurality of antenna segments, driving signals for driving the plane antenna in azimuth direction and elevation direction, respectively, are generated on the basis of a phase angle representative of phase delay of a receiving signal of one antenna segment relative to that of another antenna segment, and controls the attitude of the antenna by driving respective motors via motor drivers on the basis of the drive signals. The antenna and the drive section are covered by a radome.

Further, a device to drive two plane antennas independently of each other with their receiving surfaces maintained in parallel to each other is also known in the art, from Japanese Unexamined Patent Publication JP-A-1-261005.

Since antenna apparatus for a moving object is generally mounted on a roof of a vehicle or the like, it is highly desirable to make it as compact as possible. Particularly, it is highly desirable to make the height of the antenna as low as possible from the viewpoint of external appearance of the whole vehicle and/or of limitation of total high of a vehicle on a road. With respect this point, the antenna apparatus disclosed in the above-mentioned Japanese Unexamined Patent Publication No. 1-261005 is advantageous. However, this antenna apparatus requires drive mechanism for driving two antennas independently of each other. Therefore, the construction becomes complicated. Also, the weight of parts supported by an azimuth drive unit is increased to cause increasing of inertia in movement in the azimuth direction, resulting in slower response characteristics in tracing the satellite.

SUMMARY OF THE INVENTION

It is an object of the present invention to provide an antenna apparatus for a moving object, which has a smaller height without causing increasing of the inertia.

In order to accomplish above-mentioned object, an antenna apparatus for a moving object, according to the present invention, comprises: a casing to be mounted on a moving body; a base plate rotatably supported for rotation about a first rotary shaft which is fixed to the casing; first drive means for rotatably driving the base plate about the first rotary shaft; an antenna unit including a first antenna plate having a predetermined first beam axis, a second antenna plate having a predetermined second beam axis and connecting means for connecting the first and second antenna plates with the first and second beam axes in parallel relationship to each other and with a predetermined offset distance in the direction of the first beam axis between them, the antenna unit being rotatable about a second rotary shaft perpendicular to the first rotary shaft of the base plate; and second drive means for rotatably driving the antenna unit about the second rotary shaft.

When the casing is mounted on the moving object so that the first rotary shaft is oriented perpendicular to the land surface when the moving object travels on a flatland, the horizontal direction component, namely the azimuth direction component, of the beam axis of each of the first and second antenna plates varies over 360° with rotation of 360° of the base plate. Also, by pivoting the antenna unit about the second rotary shaft, the elevation angle of the beam axis varies.

Further, the antenna is divided into the first and second antenna plates and the first and second antenna plates are connected by the connecting means with the beam axes in parallel relationship to each other with the predetermined offset distance in the beam axis direction between them, so that the entire antenna unit construction is formed into substantially Z-shaped configuration. By driving this Z-shaped antenna unit by the second drive means, the elevation angle of the beam axis is varied so that the position of the highest point of the antenna unit at a predetermined maximum elevation angle of the beam axis can be lowered in comparison with that in an antenna unit formed with a single antenna plate.

Furthermore, since the first and second antenna plates are pivotable in the direction of elevation by the common drive means, the drive mechanism for driving the antenna unit in the direction of elevation can be simplified.

DESCRIPTION OF THE PREFERRED EMBODIMENTS

Figure 1A:
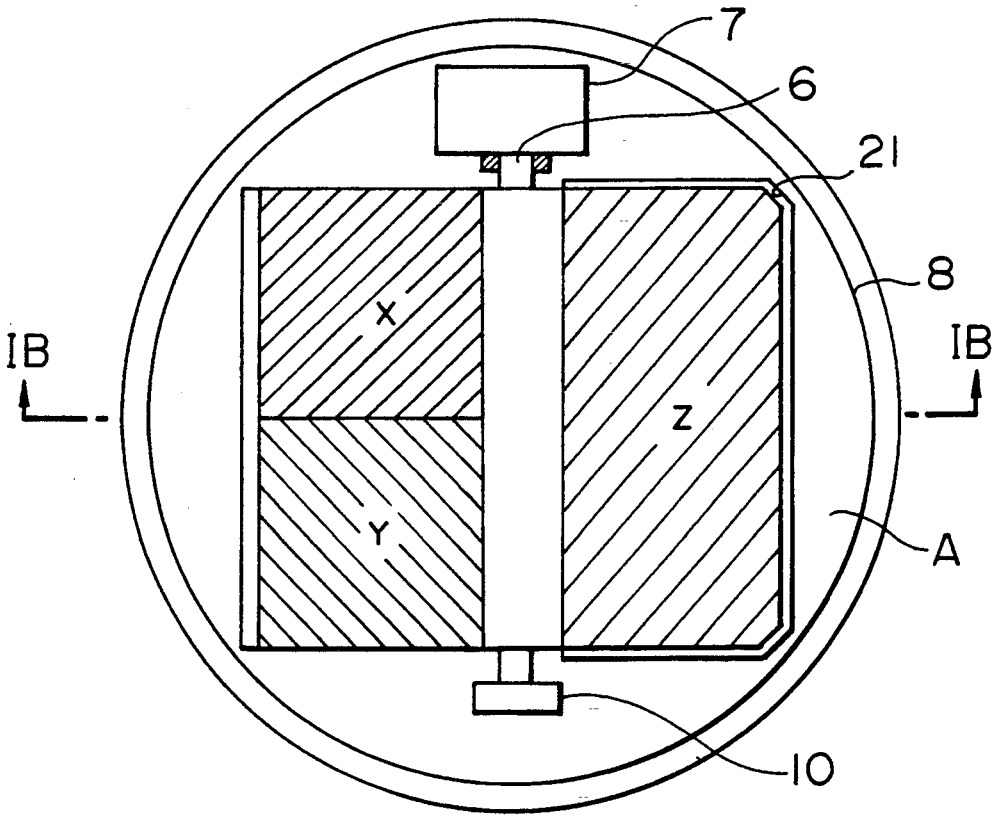
FIG. 1A is a plan view of the first embodiment of an antenna apparatus according to the invention, in which a radome is removed.

The first embodiment of the antenna apparatus will be described below with reference to FIGS. 1A and 1B.

Figure 8:
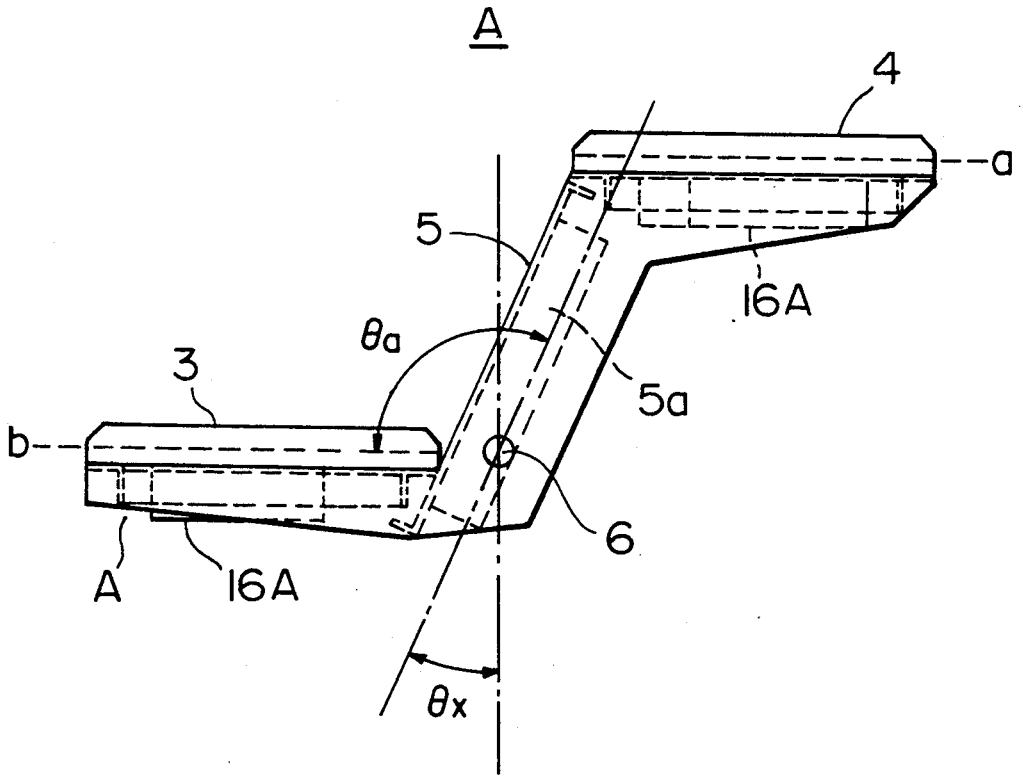
FIG. 8 is a side view of an antenna unit in the third embodiment of the antenna apparatus according to the present invention.

The antenna apparatus including an antenna unit A is mounted on a casing 1 covered by a radome 2. The casing 1 is mountable on any of various moving bodies, such as the roof of a train or an automotive vehicle, or on a ship, as shown in FIG. 2. The antenna unit A, which is the major component of the antenna apparatus, includes a first plane antenna plate 3 having a first antenna function, a second plane antenna plate 4 having a second antenna function, and a connecting plate 5 for connecting both plates in substantially a Z-shaped configuration, as shown in FIG. 1B. Although the connecting plate 5 is shown in FIG. 1B schematically, it is practically formed with a member having sufficient strength and extending over the rear sides of the first and second antenna plates as illustrated in FIG. 8 which will be discussed later with reference to another embodiment.

The first and second antenna plates are substantially rectangular plane antennas coupled at their respective sides to opposite end edges of the connecting plate. Each of the antenna plates has a beam axis usually perpendicular to its plane so that it receives most efficiently the radio wave with an angle of incidence parallel to the beam axis. Accordingly, each antenna is controlled for its orientation so that its beam axis coincide with the incident direction of the radio wave.

On the other hand, the angle between each antenna plate and the connecting plate is referred to as tilt angle. The tilt angle represents an angle in excess of right angle between a plane including the edges of the antenna plates coupled to the connecting plate, namely the plane representing the connecting plate, and the plane of the antenna plate. Accordingly, when the angle formed by the antenna plate and the connecting plate is right angle, the tilt angle is 0.

Figure 1B:
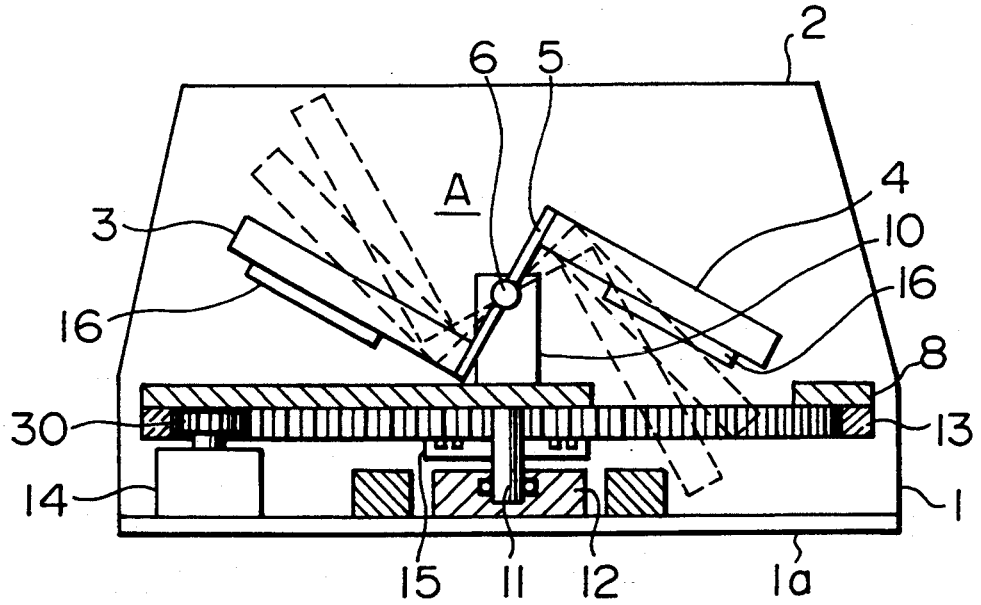
FIG. 1B is a section of the first embodiment of an antenna apparatus including the radome, taken along line 1B—1B of FIG. 1A.
Figure 2A:
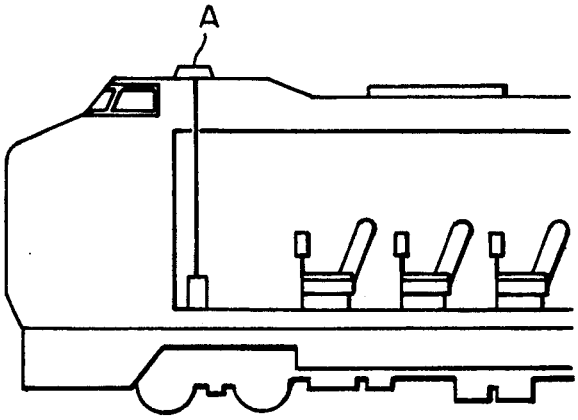
FIGS. 2A, 2B and 2C are plan views of antenna apparatus according to the present invention mounted on various moving bodies.
Figure 2B:
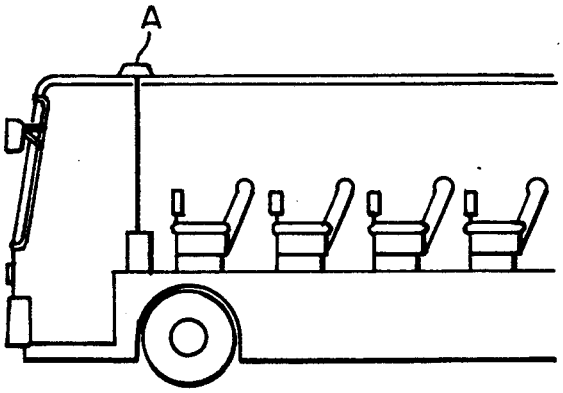
Figure 2C:
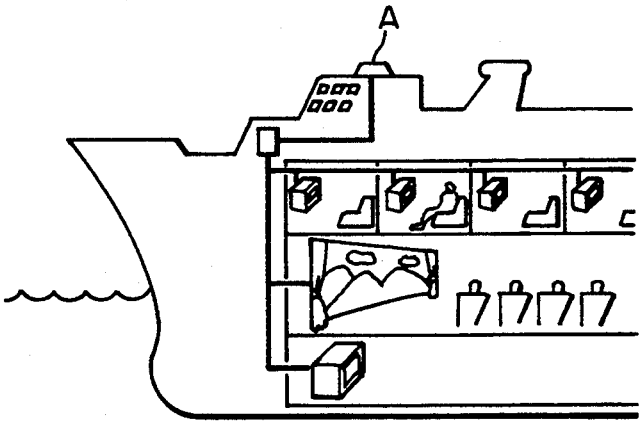
Figure 3:
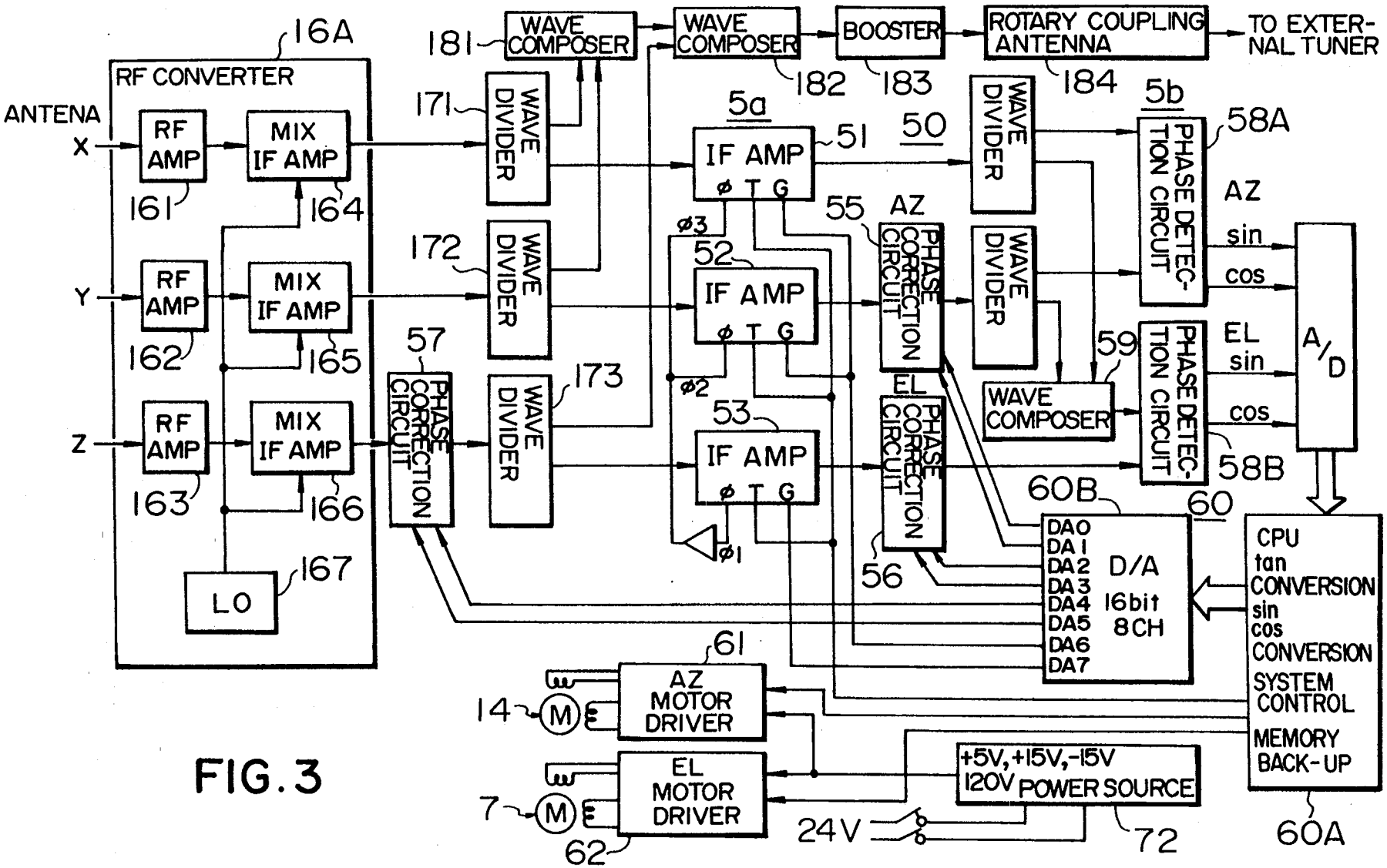
FIG. 3 is a block diagram showing a receiver circuit connected to the first embodiment of the antenna apparatus.
Figure 4:
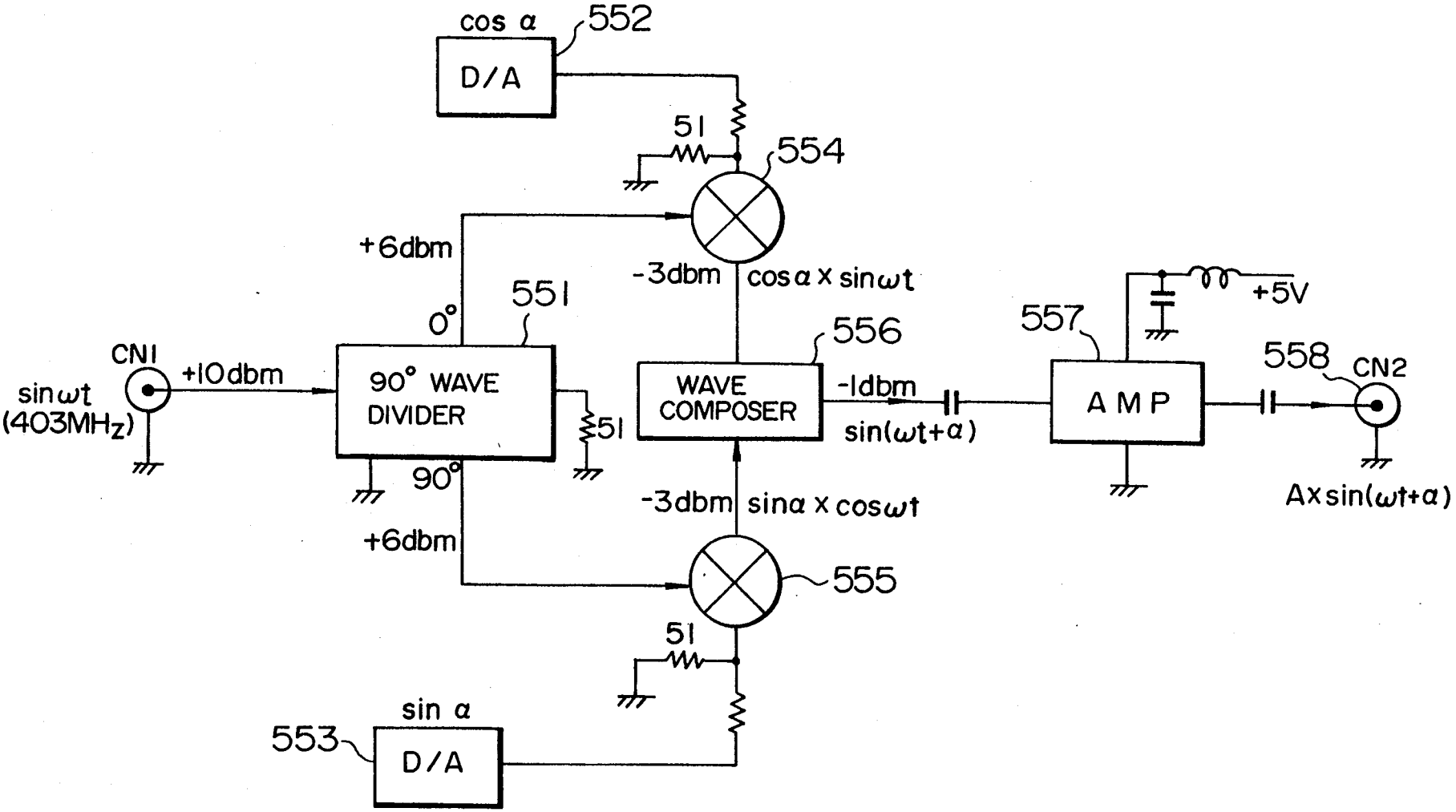
FIG. 4 is a block diagram showing construction of a phase correction circuit 55 of FIG. 3.

FIG. 1B shows an example, in which the tilt angle $\theta_x$ is 0. However, in general, as shown in FIG. 8, each of the first antenna plate 3 and the second antenna plate 4 is connected to the connecting plate 5 with a certain tilt angle $\theta_x$. The tilt angle $\theta_x$ is selected so as to avoid overlapping of the first antenna plate 3 with the second antenna plate 4, as viewed in the direction of the beam axis, over a practical driving range in rotation of the antenna unit A in the elevation direction. In practice, the tilt angle $\theta_x$ is selected to be greater than or equal to 0°. With Japanese practical drive angle range of 23°–53°, the tilt angle is appropriately selected from a range of 0° to 40°. It should be noted that the drive angle represents an angle of the beam axis of the antenna unit relative to a horizontal line.

A pivot shaft 6 is provided in the intermediate portion of the connecting plate 5 so that the antenna unit A is pivotally driven about the pivot shaft 6 in the elevation direction by means of an elevation motor 7. The antenna unit A and the elevation motor 7 are mounted on a bearing plate 10 fixed to a rotary base 8. The rotary shaft of the rotary base 8 is supported rotatably on the bearing plate 10 through a bearing 12. A belt 13 with teeth which is made of a rubber is secured on the circumference of the rotary base 8. The belt 13 is wrapped around a gear 30 secured on a rotary shaft of an azimuth motor 14 which is fixedly secured to the casing 1. Therefore, the rotary base 8 is driven to rotate in the azimuth direction over 360° relative to the casing 1 by revolution of the azimuth motor 14.

On the reverse surfaces of the first and second antenna plates 3 and 4, receiver circuits 16 including RF converters and BS tuners are arranged. On the basis of the phase difference between the receiving signal of the first antenna and the receiving signal of the second antenna, the amounts of rotations of the antenna unit A in the azimuth and elevation directions, respectively, are determined. The output of the receiver circuit 16, the control signal for the elevation motor 7 and the power are transmitted through a slip ring 15. A cut out 21 is formed on the rotary base 8. The tip end of the second antenna plate 4 reaches a point below the rotary base 8 at its lower-most position as driven about the rotary shaft 6 by the elevation motor, as shown by broken line in FIG. 1B.

Figure 6:
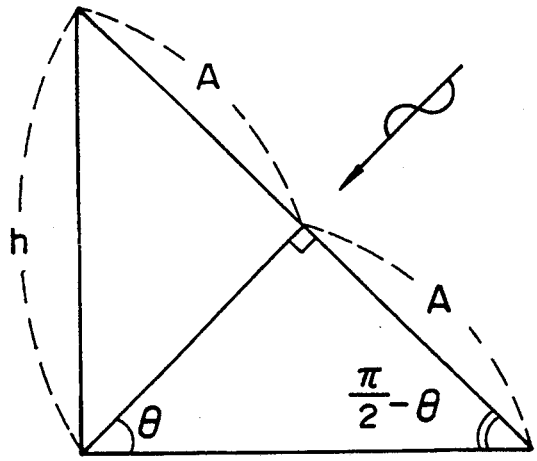
FIG. 6 PRIOR ART
FIG. 6 is an illustration showing the height of mono-plate antenna unit in the prior art.

Next, a signal system for driving the antenna unit A will be described. The first antenna plate 3 is separated into two plane antennas X and Y in the azimuth direction. On the other hand, the second antenna plate 4 is formed of a single plane antenna Z. Based on the phase difference between the output signals of the plane antennas X and Y of the first antenna plate, a drive signal in the azimuth direction (rotational direction about axis 11) is obtained. On the other hand, based on the phase difference between an output signal of the plane antenna Z and a composite output signal of the plane antennas X and Y, a drive signal for the elevation direction (rotational direction about the rotary shaft 6) is obtained. As shown in FIG. 6, the signals from the plane antennas X, Y and Z are supplied to the RF converter 16A. The RF converter 16 includes RF amplifiers 161, 162 and 163, mixer/IF amplifiers 164, 165 and 166, and a local oscillator 167 formed of a dielectric resonator. The outputs from the three plane antennas X, Y and Z are partially divided by wave dividers 171, 172 and 173, subjected to simple composition and in-phase composition by wave composers 181 and 182 and then supplied to an external tuner through a booster 183 and a rotary coupling antenna 184.

Parts of the outputs of the three plane antennas X, Y and Z are supplied to an error signal processing circuit 50 after being divided in the wave dividers 171, 172 and 173. The error signal processing circuit 50 comprises an IF amplifier circuit **5*a* including BS tuners 51, 52 and 53, an error signal detector circuit 5*b* including phase detectors 58A and 58B. The output signals of the three plane antennas X, Y and Z divided by the wave dividers 171, 172 and 173 are converted into the second intermediate frequency (approximately 403 Hz) by the BS tuners 51, 52 and 53**.

The phase detector circuit 58A has an input terminal, to which the output signal of the BS tuner 51 is input through the wave divider, and an input terminal, to which the output signal of the BS tuner 52 is input through a phase correction circuit 55 and the wave divider. The phase detector 58A generates an azimuth error signal indicative of an argument between the horizontal component of the beam axis direction of the antenna unit, i.e. direction of the antenna unit and the horizontal component of the incident direction of the radio wave on the basis of the phase difference of both input signals.

On the other hand, the output signal of the BS tuner 51 is combined by the wave composer 59 with a signal derived by phase correction of the output signal of the BS tuner 52 by the phase correction circuit 55 and then supplied to one input terminal of the phase detection circuit 58B. The phase detector circuit 58B has another input terminal, to which the output signal of the BS tuner 53 is supplied being subjected to phase correction by the phase correction circuit 56. The phase detector circuit 58B generates an elevation error signal indicative of an argument between the elevation direction component of the beam axis of the antenna unit and the elevation direction component of the incident direction of the radio wave. The azimuth error signal and the elevation error signal are supplied to a drive control circuit 60 including CPU 60A and a D/A converter 60B. CPU 60A derives driving directions of the azimuth motor 14 and the elevation motor 7 on the basis of the azimuth error signal and the elevation error signal to drive the azimuth motor 14 and the elevation motor 7 through an azimuth motor drive circuit 61 and an elevation motor drive circuit 62, respectively, so as to adjust the beam axis direction of the antenna unit to be consistent with the incident direction of the radio wave. CPU 60A calculates phase differences $\alpha 1$, $\alpha 2$ and $\alpha 3$ among the received radio waves of the plane antennas X, Y and Z and supplies to the phase correction circuits 55, 56 and 57.

The phase correction circuits 57, 55 and 56 are provided upstream of the wave divider 173 and downstream of the tuners 52 and 53, respectively, for phase-shifting the input signal Sin $\omega t$ by $\alpha$ thereby to obtain a signal ASin($\omega t+'$). Here, $\alpha$ generally represents $\alpha 1$, $\alpha 2$ and $\alpha 3$ calculated by CPU. Each of the phase correction circuits 55, 56 and 57 comprises a 90° wave divider 551 for dividing the input signal into two signals with 90° phase difference, D/A converters 552 and 553 converting digital cosine signal and digital sine signal supplied from CPU of the control circuit 60 into analog signals, a mixer 554 for mixing composing a signal having no phase difference with the input signal output from the 90° wave divider 551 and the cosine signal, a mixer 555 for composing a signal having 90° phase difference to the input signal output from the 90° wave divider and the sine signal, a wave composer 556 for composing the outputs of both mixers, and an amplifier 557. In this phase correction circuit, signal $\cos \alpha \times \sin \omega_1$ and $\sin \alpha \times \cos \omega_1$ are added by the wave composer 556 and output signal $\sin (\omega_1+\alpha)=\cos \alpha \times \sin \omega_1+\sin \alpha \times \cos \omega_1$ is generated. By employing this phase correction circuit, signal delay magnitude can be set by CPU in digital value. This permits automatic adjustment of signal delay magnitude due to difference of the signal line length. For the detail of the error signal detecting circuit 5*b*, reference is made to commonly owned Japanese Unexamined Patent Publication JP-A-2-250502. The disclosure of the above-identified publication is herein incorporated by reference for the sake of disclosure.

Next, the construction of the antenna unit A will be described in detail. The antenna unit A is pivotally driven in the elevation direction about the rotary shaft 6. According to pivotal motion, the tip end of the first antenna plate 3 rises, and conversely, the tip end of the second antenna plate 4 is lowered. The antenna unit A is required to move pivotally, in order to receive satellite broadcast in Japan, in a range of elevation angle $\theta=38°-15°$ to $38°+15°$ namely 23° to 53°. Within this angle range, it is necessary to set the total height of the casing 1 and the radome 2 as low as possible to the extent that the tip end of the first antenna plate 3 will not contact with the ceiling of the radome 2, and the tip end of the second antenna plate 4 will not contact with the bottom of the casing 1.

Figure 5:
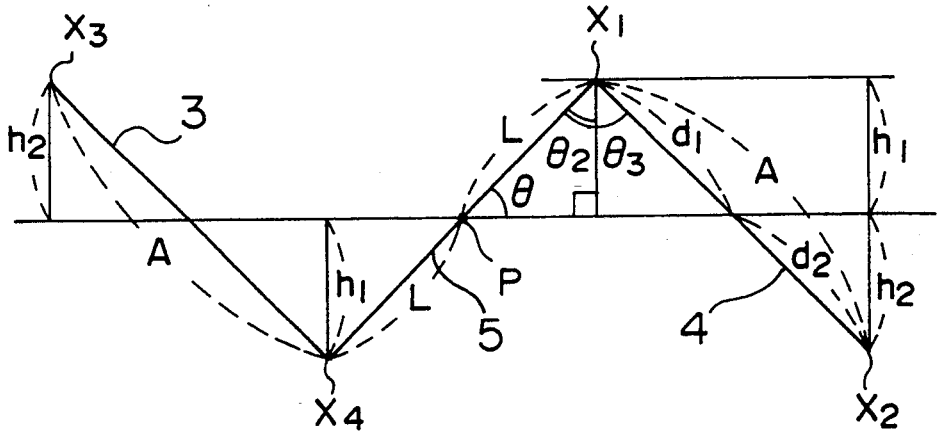
FIG. 5 is an explanatory illustration showing the height of two-plate antenna unit of the present invention.

As shown in FIG. 5, assuming the side length of each of the first and second antenna plates 3 and 4 is A, the length of the connecting plate 5 connecting both antenna plates is 2 L, the connecting plate 5, which rotates about a rotating axis P (it is assumed that the rotating axis P is located at a center of the connecting plate 5), makes an angle $\theta$ with the horizontal direction, the height of the highest point $X_1$ of the second antenna plate relative to the rotating axis P is $h_1$, and the height of the lowest point $X_2$ relative to the rotating axis P is $h_2$, the heights $h_1$ and $h_2$ can be expressed by:

$$h_1=L \sin \theta$$

$$h_2=A \cos (\theta_x+\theta)-L \sin \theta$$

Here, $\theta_2+\theta_3$ incorporates the tilt angle $\theta_x$, and therefore $\theta_2+\theta_3=90°+\theta_x$. Since $\theta_2=90°-\theta$, the following equations can be established.

$$\begin{aligned}
\theta_3 &= 90° + \theta_x - (90° - \theta) = \theta_x + \theta \\
d_1 &= h_1 \cos^{-1} (\theta_x + \theta) \\
d_2 &= A - d_1 = A - h_1 \cos^{-1} (\theta_x + \theta) \\
h_2 &= d_2 \cos (\theta_x + \theta) \\
&= [A - h_1 \cos^{-1} (\theta_x + \theta)] \cos (\theta_x + \theta) \\
&= A \cos (\theta_x + \theta) - d_1 \\
&= A \cos (\theta_x + \theta) - L \sin \theta
\end{aligned}$$

Here, consideration is given to the highest point $X_3$ and the lowest point $X_4$ of the first antenna plate 3 corresponding to the second antenna plate rotated by 180° about the rotating axis P.

In case of $h_1>h_2$, the highest point of the antenna unit A is $X_1$ and the lowest point thereof is $X_4$, and thus the total height H of the antenna unit A can be expressed by:

$$H=h_1+h_1=2h_1;$$

in case of $h_1<h_2$, the highest point of the antenna unit A is $X_3$ and the lowest point thereof is $X_2$, and thus the total height H of the antenna unit can be expressed by:

$$H=h_2+h_2=2h_2; \text{ and}$$

in case of $h_1=h_2$, the total height H can be expressed by:

$$H=h_1+h_2=2h_1=2h_2.$$

On the other hand, assuming that this antenna is formed with a single antenna, the total height becomes, as shown in FIG. 6;

$$\begin{aligned}
h &= 2 A \sin [90° - (\theta_x + \theta)] \\
&= 2 A \cos (\theta_x + \theta)
\end{aligned}$$

Since it is necessary to limit the total height H to a value lower than that in the case where the antenna unit is formed with a single antenna, when $h_1>h_2$, since $h>H=h_1+h_1$, $2A \cos (\theta_x+\theta)>2L \sin \theta$ $[A \cos (\theta_x+\theta)]/(\sin \theta)>L$ when $h_1<h_2$, since $h>H=h_2+h_2$, $2A \cos (\theta_x+\theta)>2(A \cos (\theta_x+\theta)-L \sin \theta)$ $0>-L \sin \theta$ When satellite broadcast is received in Japan, the elevation angle $\theta$ is in a range of $38°-15°$ to $38°+15°$, namely 23° to 53°. In the range of the elevation angle of 23° to 53°, $\sin \theta>0$, and, accordingly $0<L$ When $h_1=h_2$, since $h>H=h_1+h_2$, $2A \cos (\theta_x+\theta)>[A \cos (\theta_x+\theta)-L \sin \theta]+L \sin \theta=A \cos (\theta_x+\theta)$ $2>0$ This condition is always established. Therefore, when $0<L<A\cos(\theta_x+\theta)/\sin\theta$ is established, the total height can be made lower than that in the case of the single antenna.

Next, discussion will follow of an example of practical design. In the case of receiving the satellite broadcast by Nippon Hoso Kyokai (NHK) in the receiving area covering in the range of latitude from Hokkaido to Okinawa by using an antenna having the antenna length A=140 mm and the tilt angle $\theta=0°$, the elevation angle is in a range of 23° to 53°.

Table 1 shows variation of the total height H when the length 2 L of the connection plate 5 is varied. As will be appreciated from the Table 1, the point to satisfy the minimum height condition at both of the minimum angle 23° and the maximum angle 53°, is the point where the height calculated with respect to 23° becomes smaller than the calculated height with respect to 53°. In the example of Table 1, this point lies at 2 L=215 mm, more exactly at intermediate point between 216 mm to 217 mm. At this point, the total height becomes 173 mm. This height is 33% lower than the height of the single plate antenna, which is 258 mm.

TABLE 1

| 2L | $\theta$ = 23° | $\theta$ = 53° | Remarks |
|---|---|---|---|
| 0 | $2h_2$ = 257.7 | $2h_2$ = 168.5 | |
| 20 | 249.9 | 152.5 | |
| 40 | 242.1 | 136.6 | |
| 60 | 234.3 | 120.6 | |
| 80 | 226.5 | 104.6 | |
| 100 | 218.6 | $2h_1$ = 88.7 | |
| 105 | 216.7 | 84.7 | Minimum at 53° |
| 110 | 214.8 | 87.8 | |
| 120 | 210.9 | 95.8 | |
| 140 | 203.0 | 111.8 | |
| 160 | 195.2 | 127.8 | |
| 180 | 187.4 | 143.8 | |
| 200 | 179.6 | 159.7 | |
| 210 | 175.7 | 167.7 | |
| 215 | 173.7 | 171.7 | cross point |
| 220 | 171.8 | 175.7 | |
| 230 | 167.9 | 183.7 | |

Next, in the case where the two-plate antenna is provided with a substantial tilt angle, the variation of the total height H of the antenna having the antenna length A=140 mm and the tilt angle $\theta_x=23°$ is shown in Table 2 relative to variation of the length 2 L of the connecting plate 5. As will be appreciated from the Table 2, the point for satisfying the minimum height condition both at the minimum angle 23° and the maximum angle 53°, resides at 2 L=160 mm, more exactly at a point intermediate between 163 mm to 164 mm. At this point, the total height H becomes 131 mm. This is 33% lower than the case of the single-plate antenna, i.e. 195 mm, and 25% lower than the case of the two-plate antenna with no tilt angle, i.e. 174 mm.

TABLE 2

| 2L | $\theta$ = 23° | $\theta$ = 53° | Remarks |
|---|---|---|---|
| 0 | $2h_2$ = 194.5 | $2h_2$ = 67.7 | |
| 20 | 186.7 | 51.5 | |
| 40 | 178.9 | 35.8 | |
| 45 | 176.9 | $2h_1$ = 35.9 | Minimum at 53° |
| 60 | 171.0 | 47.9 | |
| 80 | 163.3 | 59.9 | |
| 100 | 155.4 | 79.9 | |
| 120 | 147.6 | 95.8 | |
| 140 | 139.8 | 111.8 | |
| 160 | 132.0 | 127.8 | |
| 165 | 130.0 | 131.8 | cross point |
| 180 | 124.2 | 143.8 | |

TABLE 2-continued

| 2L | $\theta$ = 23° | $\theta$ = 53° | Remarks |
|---|---|---|---|
| 200 | 116.4 | 159.7 | |
| 220 | 108.6 | 175.7 | |
| 240 | 100.7 | 195.7 | |

Figure 7A:
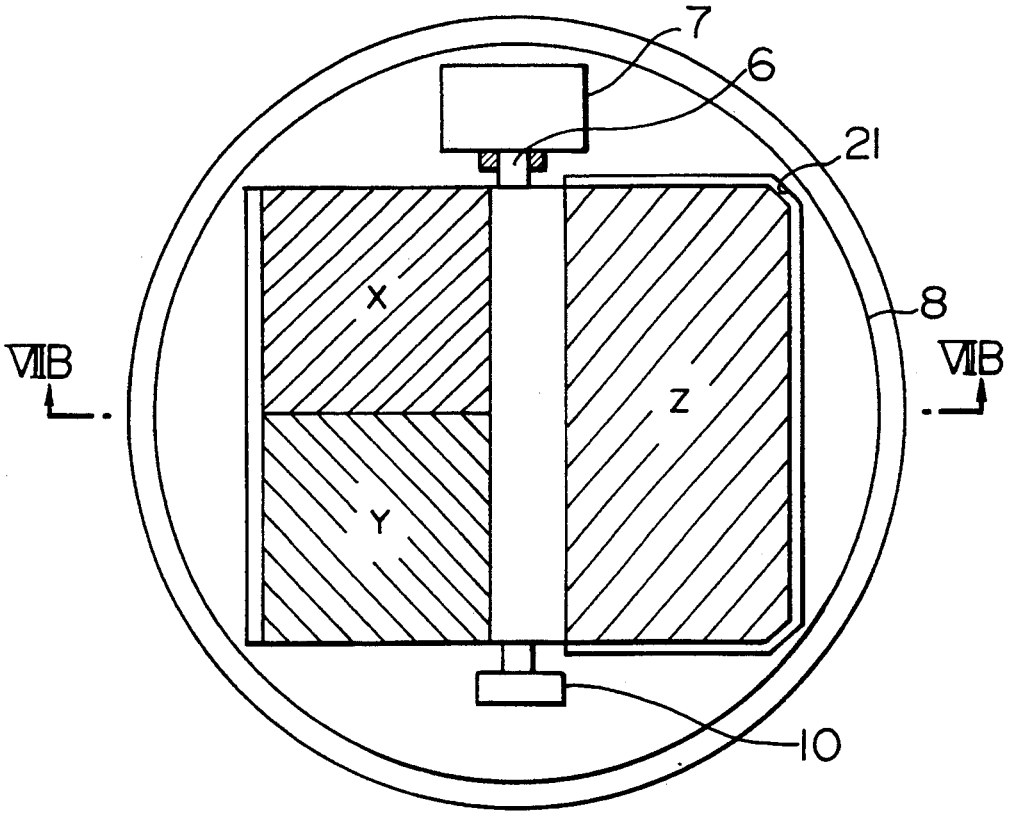
FIG. 7A is a section of the second embodiment of the antenna apparatus according to the present invention, in which the radome is removed.
Figure 7B:
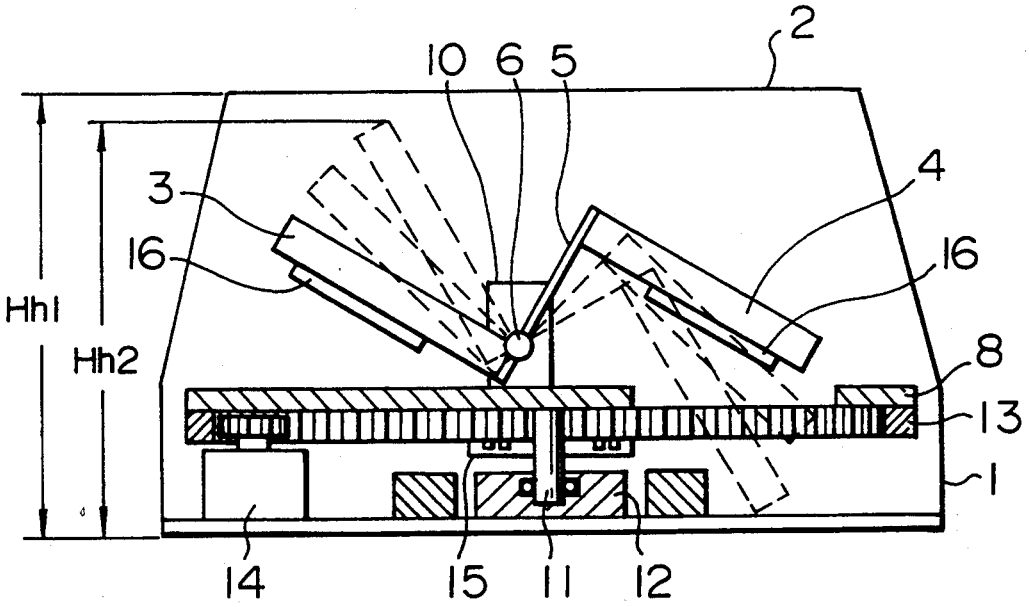
FIG. 7B is a section taken along line VIIB—VIIB of FIG. 7A.

Next, the second embodiment of the antenna apparatus for the moving body according to the present invention will be discussed with reference to FIGS. 7A and 7B. The second embodiment is different from the first embodiment in that the position of the rotary shaft 6 for rotation in the direction of elevation is shifted from the center of the connecting plate 5 toward the first antenna plate 3. By shifting the center for rotation in the elevation direction, the total height can be lowered from $Hh_1$ to $Hh_2$, and the spacial efficiency of the antenna can be increased thereby making the casing compact.

The third embodiment of the antenna apparatus of the present invention will be described below with reference to FIGS. 8, 9 and 10. In this embodiment, the tilt angle is applied to the Z-shaped antenna and the drive mechanism in the azimuth direction is different from that in the first and second embodiments. The antenna unit A includes the first antenna plate 3 and the second antenna plate 4 connected to the connecting plate 5 with an angle of 90° + a tilt angle $\theta_x$. The rotating axis of the antenna unit A for rotation in the elevation direction is offset toward the first antenna plate 3 similarly to the second embodiment. On the rear sides of the first and second antenna plates 3 and 4, RF converters 16A are fixedly mounted. On the other hand, on the rear side of the connection plate 5, the BS tuner **5*a*** is fixedly mounted.

Figure 9:
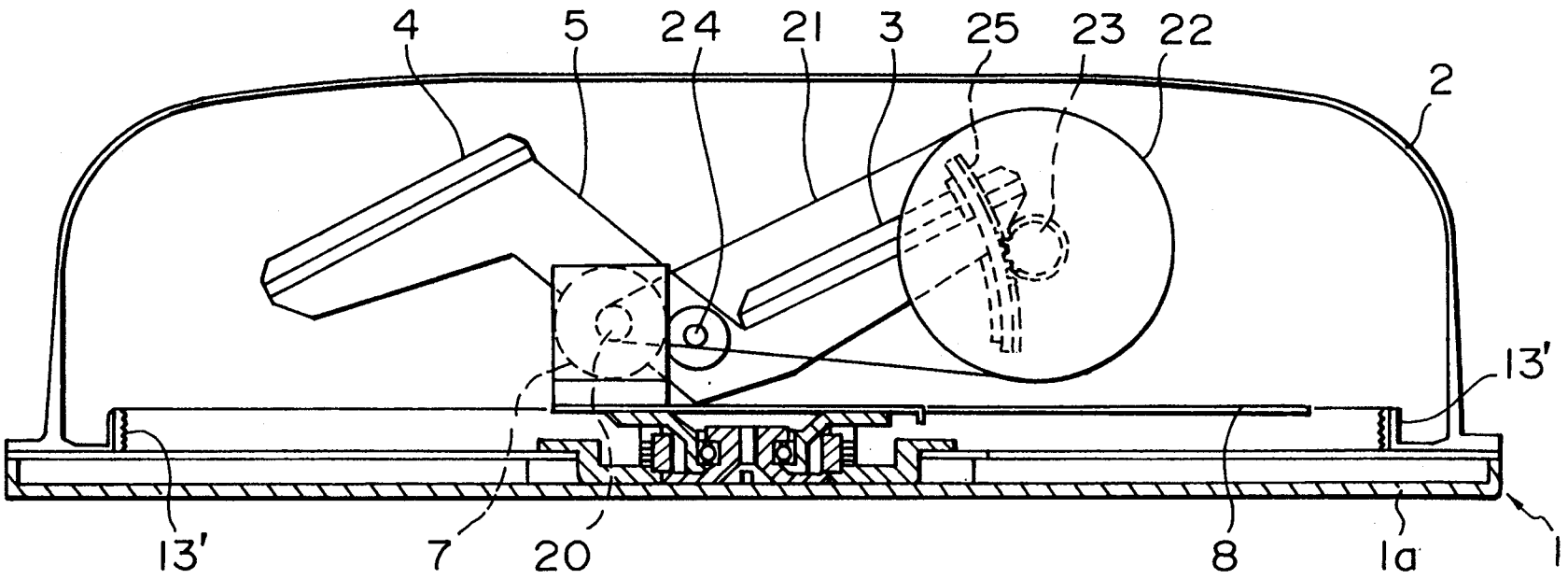
FIG. 9 is a partial section showing construction of the third embodiment of the antenna apparatus.
Figure 10:
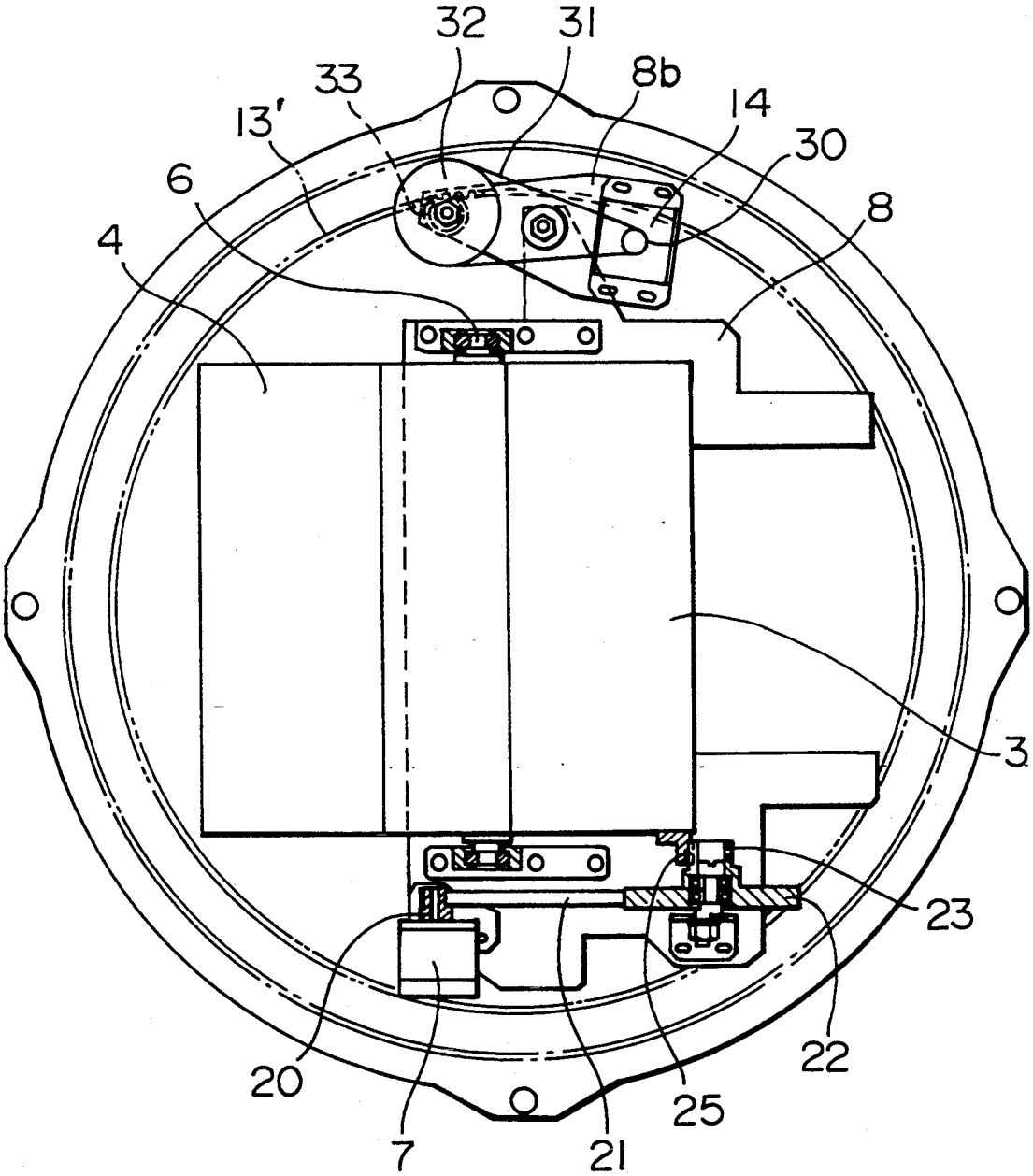
FIG. 10 is a plan view showing construction of the third embodiment of the antenna apparatus.

FIG. 9 is a partial section of the antenna apparatus to be used for explaining the manner of pivotally driving the antenna unit A in the elevation direction. FIG. 10 is a plan view of the antenna apparatus to be used for explaining the manner of pivotally driving the antenna unit in the elevation direction and that in the azimuth direction. The elevation motor 7 is fixed to a rotary base 8. On the rotary shaft of the elevation motor 7, a pulley 20 is mounted for co-rotation therewith. The driving torque of the elevation motor 7 is transmitted from the pulley 20 to a pulley 22 through a drive belt 21. A pinion gear 23 is provided in coaxial with the pulley 22. On the side of the first antenna plate 3 is fixed, a rack 25 having teeth formed along a circle about the rotating axis 24 in the elevation direction of the antenna unit A. The teeth of the rack 25 is meshed with the pinion gear 23 to be driven circumferentially by the driving torque transmitted to the pinion gear. By this, the antenna unit A is driven for rotation in the elevation direction. Namely, the driving torque of the elevation motor 7 is transmitted to the rack 25 through the pulley 20, the belt 21, the pulley 22 and the pinion gear 23 and thus the antenna unit A is driven for rotation in the elevation direction. With the construction as mentioned above, the driving torque of the elevation motor 7 can be transmitted to the antenna unit A with appropriate reduction rate without providing complicate or bulky reduction gear unit, and thus permits positioning of the antenna unit with high precision.

Next, the manner of driving of the antenna unit A in the azimuth direction will be described. As shown in FIG. 10, the azimuth motor 14 is fixed on the rotary base 8 via a sub-base **8*b*. On the rotary shaft of the azimuth motor 14, a pulley 30 is fixed for rotation therewith. The pulley 30 is coupled with another pulley 32 via a drive belt 31. A pinion 33 is provided coaxially with the pulley 32. Through the pair of pulleys 30 and 32 and the drive belt 31, the driving torque of the azimuth motor 14 is transmitted to the pinion 33. The pinion 33 is placed to mesh with the teeth of a belt 13' fixedly secured on the bottom plate 1***a* of the casing along its outer circumference. The driving torque of the azimuth motor 14 is thus transmitted through the pulleys 30 and 32, the drive belt 31 and the pinion 33 to the belt 13' with teeth which serves like a rack. Since the cogged belt 13' is rigidly secured on the casing 1, the rotary base 8 rotates relative to the casing 1 thereby varying the azimuth direction of the antenna unit A.

In the embodiment set forth above, the antenna apparatus employs the Z-shaped two-plate antenna construction. With the foregoing embodiment, a distance between two antenna plates as viewed in the incident direction of radio wave to be received, or an apparent distance is set small so that the two antenna plates can be seen as if it is a single-plate antenna in the incident direction. Since the apparent distance between the antenna plates and the trace control range are proportional to each other, it facilitates control with wider trace control range when it is controlled within main lobe. Furthermore, when two antennas are simply positioned in close proximity, mutual interference may be caused. However, according to the present invention, since two antenna plates are positioned spaced apart by a given distance in a direction in which the antenna plates receive the radio wave with a certain phase difference, mutual interference is hardly caused.

In the design of a practical antenna, it is usual to add a margine angle of one or two degrees to a tilt angle $\theta_x$ theoretically determined based on the range of the elevation angle in which the radio wave of BS broadcasting is possibly received. By making the antenna in this manner, it is possible to prevent a shadow of the first antenna plate from falling on the second antenna plate when receiving the radio wave of BS broadcasting at the northernmost or southernmost area in the receiving range of BS broadcasting in Japan.

It should be appreciated that, although the foregoing discussion is given for reception of radio wave in the BS broadcasting system, the equivalent effect can be obtained for reception of radio wave of CS broadcasting system using communication satellites. Also, though the foregoing discussion has been directed to a specific drive angle range in the elevation direction for reception of the broadcast in Japan, the drive angle range is, of course, determined at optimal drive angles in elevation direction depending upon the latitude of the receiving position and the direction of the satellite.

What is claimed is:

1. An antenna apparatus for a moving object comprising:

a casing mountable on a moving object;

a base plate rotatably supported for rotation about a first rotary shaft which is fixed to said casing;

first drive means for rotatably driving said base plate about said first rotary shaft;

an antenna unit for receiving radio waves and including a first antenna plate having a predetermined first beam axis, a second antenna plate having a predetermined second beam axis and connecting means for connecting said first and second antenna plates, with said first and second beam axes being oriented parallel to each other and with said antenna plates being spaced apart at a predetermined fixed offset distance between them along a line which is parallel to said first and second beam axes, said antenna unit with said first and second antenna plates being rotatable about a common second rotary shaft perpendicular to said first rotary shaft, wherein said predetermined fixed offset distance between said first antenna plate and said second antenna plate is unchanged with rotation of said antenna unit about said second rotary shaft; and second drive means for rotatably driving said antenna unit about said second rotary shaft.

2. An antenna apparatus for a moving object according to claim 1, wherein each of said first and second antenna plates is fixed to said connecting means at an angle which exceeds 90° by a predetermined tilt angle.

3. An antenna apparatus for a moving object according to claim 1, wherein said first drive means includes a first drive motor fixed to said casing, a belt having teeth formed thereon and provided on the outer circumference of said base plate, and means for transmitting the driving force of said first motor to said belt.

4. An antenna apparatus for a moving object according to claim 1, wherein said first drive means includes a first drive motor fixed to said base plate, a belt having teeth formed thereon and provided to surround said base plate, and means for transmitting the driving force of said first motor to said belt.

5. An antenna apparatus for a moving object according to claim 1, wherein said second rotary shaft is connected to a rotating center of said connecting means so that said antenna unit rotates about the rotating center of said connecting means.

6. An antenna apparatus according to claim 1, wherein each of said first and second antenna plates is a substantially plane antenna.

7. An antenna apparatus according to claim 6, wherein said connecting means includes a connecting plate and each of said first and second antenna plates is fixed to said connecting plate so that each of the antenna plates makes an angle larger than 90° by a predetermined tilt angle with said connecting plate.

8. An antenna apparatus according to claim 6, wherein said first drive means includes a first drive motor fixed to said casing, a belt having teeth formed thereon and provided on the outer circumference of said base plate and means for transmitting the driving force of said first motor to said belt.

9. An antenna apparatus according to claim 6, wherein said first drive means includes a first drive motor fixed to said base plate, a belt having teeth formed thereon and provided to surround said base plate and means for transmitting the driving force of said first motor to said belt.

10. An antenna apparatus according to claim 6, wherein said second rotary shaft is connected to a rotating center of said connecting means so that said antenna unit rotates about the rotating center of said connecting means.

11. An antenna apparatus according to claim 5, wherein said rotating center of said connecting means is disposed at a center of the connecting means.

12. An antenna apparatus according to claim 11, wherein said connecting means includes a connecting plate and each of said first and second antenna plates is fixed to said connecting plate so that each of the antenna plates makes an angle larger than 90° by a predetermined tilt angle with said connecting plate.

13. An antenna apparatus according to claim 11, wherein said first drive means includes a first drive motor fixed to said casing, a belt having teeth formed thereon and provided on the outer circumference of said base plate and means for transmitting the driving force of said first motor to said belt.

14. An antenna apparatus according to claim 11, wherein said first drive means includes a first drive motor fixed to said base plate, a belt having teeth formed thereon and provided to surround said base plate and means for transmitting the driving force of said first motor to said belt.

15. An antenna apparatus according to claim 11, wherein each of said first and second antenna plates is a substantially plane antenna.

16. An antenna apparatus according to claim 15, wherein said connecting means includes a connecting plate and each of said first and second antenna plates is fixed to said connecting plate so that each of the antenna plates makes an angle larger than 90° by a predetermined tilt angle with said connecting plate.

17. An antenna apparatus according to claim 15, wherein said first drive means includes a first drive motor fixed to said casing, a belt having teeth formed thereon and provided on the outer circumference of said base plate and means for transmitting the driving force of said first motor to said belt.

18. An antenna apparatus according to claim 15, wherein said first drive means includes a first drive motor fixed to said base plate, a belt having teeth formed thereon and provided to surround said base plate and means for transmitting the driving force of said first motor to said belt.

19. An antenna apparatus according to claim 1, wherein said antenna apparatus is used for receiving a radio wave transmitted from a broadcasting satellite.

20. An antenna apparatus according to claim 19, wherein said connecting means includes a connecting plate and each of said first and second antenna plates is fixed to said connecting plate so that each of the antenna plates makes an angle larger than 90° by a predetermined tilt angle with said connecting plate.

21. An antenna apparatus according to claim 19, wherein said first drive means includes a first drive motor fixed to said casing, a belt having teeth formed thereon and provided on the outer circumference of said base plate and means for transmitting the driving force of said first motor to said belt.

22. An antenna apparatus according to claim 19, wherein said first drive means includes a first drive motor fixed to said base plate, a belt having teeth formed thereon and provided to surround said base plate and means for transmitting the driving force of said first motor to said belt.

23. An antenna apparatus according to claim 19, wherein said second rotary shaft is connected to a rotating center of said connecting means so that said antenna unit rotates about the rotating center of said connecting means.

24. An antenna apparatus for a moving object, comprising:

a casing mountable on a moving object;

a base plate rotatably supported for rotation about a first rotary shaft which is fixed to said casing;

first drive means for rotatably driving said base plate about said first rotary shaft;

an antenna unit including a first antenna plate having a predetermined first beam axis, a second antenna plate having a predetermined second beam axis and connecting means for connecting said first and second antenna plates, with said first and second beam axes being oriented parallel to each other and with said antenna plates being positioned at a predetermined fixed offset distance between them along a line which is parallel to said first and second beam axes, said antenna unit being rotatable about a second rotary shaft perpendicular to said first rotary shaft;

second drive means for rotatably driving said antenna unit about said second rotary shaft;

wherein said first drive means includes a first drive motor fixed to said base plate, a belt having teeth formed thereon and provided to surround said base plate, and means for transmitting the driving force of said first motor to said belt; and wherein said belt is fixed to said casing.

25. An antenna apparatus for a moving object comprising:

a casing mountable on a moving object;

a base plate rotatably supported for rotation about a first rotary shaft which is fixed to said casing;

first drive means for rotatably driving said base plate about said first rotary shaft;

an antenna unit including a first antenna plate having a predetermined first beam axis, a second antenna plate having a predetermined second beam axis and connecting means for connecting said first and second antenna plates, with said first and second beam axes being oriented parallel to each other and with said antenna plates being positioned at a predetermined fixed offset distance between them along a line which is parallel to said first and second beam axes, said antenna unit being rotatable about a second rotary shaft perpendicular to said first rotary shaft;

second drive means for rotatably driving said antenna unit about said second rotary shaft;

wherein said second rotary shaft is connected to a rotating center of said connecting means so that said antenna unit rotates about the rotating center of said connecting means; and wherein said antenna unit is mounted for rotation about said second rotary shaft over a predetermined angular range, said base plate is formed with an opening, and the position of said rotating center of said connecting means is so selected that a tip end of one of said first and second antenna plates extends through said opening below said base plate when said antenna unit rotates by a predetermined maximum angle in said predetermined angular range.

26. An antenna apparatus comprising:

a casing mountable on a moving object;

a base plate rotatably supported for rotation about a first rotary shaft which is fixed to said casing;

first drive means for rotatably driving said base plate about said first rotary shaft;

an antenna unit including a first antenna plate having a predetermined first beam axis, a second antenna plate having a predetermined second beam axis and connecting means for connecting said first and second antenna plates, with said first and second beam axes being oriented parallel to each other and with said antenna plates being positioned at a predetermined fixed offset distance between them along a line which is parallel to said first and second beam axes, said antenna unit being rotatable about a second rotary shaft perpendicular to said first rotary shaft; and second drive means for rotatably driving said antenna unit about said second rotary shaft;

wherein said second rotary shaft is connected to a rotating center of said connecting means so that said antenna unit rotates about the rotating center of said connecting means; and wherein said rotating center of said connecting means is shifted toward one of said first and second antenna plates from a center point of the connecting means, which is at equal distances from said first and second antenna plates.

27. An antenna apparatus comprising:

a casing mountable on a moving object;

a base plate rotatably supported for rotation about a first rotary shaft which is fixed to said casing;

first drive means for rotatably driving said base plate about said first rotary shaft;

an antenna unit including a first antenna plate having a predetermined first beam axis, a second antenna plate having a predetermined second beam axis and connecting means for connecting said first and second antenna plates, with said first and second beam axes being oriented parallel to each other and with said antenna plates being positioned at a predetermined fixed offset distance between them along a line which is parallel to said first and second beam axes, said antenna unit being rotatable about a second rotary shaft perpendicular to said first rotary shaft; and second drive means for rotatably driving said antenna unit about said second rotary shaft;

wherein said second rotary shaft is connected to a rotating center of said connecting means so that said antenna unit rotates about the rotating center of said connecting means; and wherein said rotating center of said connecting means is positioned in a vicinity of a connecting portion between one of said first and second antenna plates and said connecting means.

28. An antenna apparatus comprising:

a casing mountable on a moving object;

a base plate rotatably supported for rotation about a first rotary shaft which is fixed to said casing;

first drive means for rotatably driving said base plate about said first rotary shaft;

an antenna unit including a first antenna plate having a predetermined first beam axis, a second antenna plate having a predetermined second beam axis and connecting means for connecting said first and second antenna plates, with said first and second beam axes being oriented parallel to each other and with said antenna plates being positioned at a predetermined fixed offset distance between them along a line which is parallel to said first and second beam axes, said antenna unit being rotatable about a second rotary shaft perpendicular to said first rotary shaft; and second drive means for rotatably driving said antenna unit about said second rotary shaft;

wherein said second rotary shaft is connected to a rotating center of said connecting means so that said antenna unit rotates about the rotating center of said connecting means; and wherein said antenna unit is mounted for rotation about said second rotary shaft over a predetermined angular range, said base plate is formed with an opening, and the height of said rotating center of said connecting means relative to a surface of said base plate is so selected that a tip end of one of said first and second antenna plate extends through said opening below said base plate when said antenna unit rotates by a predetermined angular range.

29. An antenna apparatus comprising:

a casing mountable on a moving object;

a base plate rotatably supported for rotation about a first rotary shaft which is fixed to said casing;

first drive means for rotatably driving said base plate about said first rotary shaft;

an antenna unit including a first antenna plate having a predetermined first beam axis, a second antenna plate having a predetermined second beam axis and connecting means for connecting said first and second antenna plates, with said first and second beam axes being oriented parallel to each other and with said antenna plates being positioned at a predetermined fixed offset distance between them along a line which is parallel to said first and second beam axes, said antenna unit being rotatable about a second rotary shaft perpendicular to said first rotary shaft; and second drive means for rotatably driving said antenna unit about said second rotary shaft;

wherein each of said first and second antenna plates is fixed to said connecting means at an angle which exceeds 90° by a predetermined tilt angle $\theta_x$; and wherein each of said first and second antenna plates is substantially in a rectangular configuration and connected to said connecting means at its one side, and the predetermined offset distance 2 L is set to satisfy $$0<L<A\cos(\theta+\theta_x)/\sin\theta$$

where A indicates length between said one side and an opposite side and $\theta_x$ indicates the predetermined tilt angle.

30. An antenna apparatus comprising:

a casing mountable on a moving object;

a base plate rotatably supported for rotation about a first rotary shaft which is fixed to said casing;

first drive means for rotatably driving said base plate about said first rotary shaft;

an antenna unit including a first antenna plate having a predetermined first beam axis, a second antenna plate having a predetermined second beam axis and connecting means for connecting said first and second antenna plates, with said first and second beam axes being oriented parallel to each other and with said antenna plates being positioned at a predetermined fixed offset distance between them along a line which is parallel to said first and second beam axes, said antenna unit being rotatable about a second rotary shaft perpendicular to said first rotary shaft;

second drive means for rotatably driving said antenna unit about said second rotary shaft;

wherein each of said first and second antenna plates is fixed to said connecting means at an angle which exceeds 90° by a predetermined tilt angle $\theta_x$; and wherein said predetermined tilt angle $\theta_x$ is greater than 0.

* * * * *